United States Patent [19]

Chen

[11] Patent Number: 5,048,135

[45] Date of Patent: Sep. 17, 1991

[54] SWINGING ASSEMBLY FOR CRIBS

[76] Inventor: Chin Y. Chen, 9-1, Lane 161, Hsing An Road Sec. 1, Taichung, Taiwan

[21] Appl. No.: 644,452

[22] Filed: Jan. 23, 1991

[51] Int. Cl.[5] ..... A47D 9/02
[52] U.S. Cl. ..... 5/109; 5/106
[58] Field of Search ..... 5/101, 103, 105, 109

[56] References Cited

U.S. PATENT DOCUMENTS

| | | | |
|---|---|---|---|
| 277,753 | 5/1983 | Logan | 5/109 |
| 1,727,635 | 9/1929 | Crane | 5/108 X |
| 2,544,298 | 3/1951 | Chodacki et al. | 5/109 |
| 2,793,374 | 5/1957 | Doud | 5/109 X |
| 3,261,032 | 6/1966 | Reardon | 5/108 |
| 4,590,631 | 5/1986 | Varney | 5/101 |

FOREIGN PATENT DOCUMENTS

| | | | |
|---|---|---|---|
| 3530527 | 9/1987 | Fed. Rep. of Germany | 5/109 |

*Primary Examiner*—Michael F. Trettel

[57] ABSTRACT

A swinging assembly for cribs comprises a crib with two opposite inner frames at its two opposite sides, two outer frames matching the two inner frames, two lateral braces supporting the inner frames, an electrical apparatus, and a magnetic device. A switching apparatus is disposed between the lateral brace and the outer frame. The electrical apparatus is installed in a lower interior of the lateral brace. The electrical apparatus has a silicon controlled rectifier, two diodes and a transformer. A non-magnetic partition separates the electrical apparatus and the magnetic device. The magnetic device has two permanent magnets which are positioned by a securing seat. The securing seat is positioned by a corrugated plate which is disposed under the crib.

2 Claims, 4 Drawing Sheets

SWINGING ASSEMBLY FOR CRIBS

BACKGROUND OF THE PRESENT INVENTION

The present invention relates to a swaying apparatus, and more particularly to a swaying apparatus capable of making reciprocating motion by means of an electrical apparatus and its subsidiary devices, which are designed to install at the lateral side of the swaying body to ensure operational safety. The extend of the movement of the swaying body is under the control of two magnets which are disposed apart and cam be adjusted as desired.

The swaying apparatus mentioned above is commonly applied to a crib, which is known as an electronic crib. However, the structural layout of a conventional electronic crib is defective in that the swaying apparatus is mounted at the bottom portion of the swaying body of the crib, resulting in installing and operational difficulties. In addition, the range within which a conventional electronic crib can sway is greatly limited to a maximum of thirty degrees. Furthermore, the unwanted mechanical noise and vibration are unavoidable consequences of a defective design in which the permanent magnets and the excited magneto-electrical apparatus are disposed face to face. The conventional electronic crib is further defective in that it is not equipped with means to refrain the swaying body of the crib from moving. Finally, the swaying body of the conventional electronic crib is so assembled in a cantilever manner that it is prone to be hazardous to a child.

SUMMARY OF THE PRESENT INVENTION

The primary objective of the present invention is to provide a quiet vibration-free swaying apparatus which is laterally affixed to the swaying body capable of making a reciprocating motion.

It is another objective of the present invention to provide a swaying apparatus with means to refrain the swaying body from moving.

It is still another objective of the present invention to provide a swaying apparatus, Which is mounted in a concealed manner so as to ensure to safety of children.

In keeping with the principles of the present invention, the objective are accomplished by a swaying apparatus, which comprises mainly a support frame, a swaying body capable of generating magnetic force by virtue of the induction of an excited magnetic circuit, an electrical apparatus, and a magnetic device. The support frame is mounted on the lateral side of the swaying body. The one side of the swaying body has a non-conductive partition positioned correspondingly to the support frame. The electrical apparatus is installed at a predetermined position in front of the support frame at a predetermined interval. The magnetic apparatus is disposed on the back of partition located at one side of the swaying body. The magnetic apparatus comparatus comprises two magnets which are disposed adjustably in a set member. The magnetic apparatus is affixed to the swaying body by means of the kset member. Two magnets are positioned in such a manner that they are arranged right in front of the electrical apparatus, with partition being sandwiched between two magnets and the electrical apparatus.

DESCRIPTION OF THE PREFERRED EMBODIMENT OF THE PRESENT INVENTION

Figure 1:
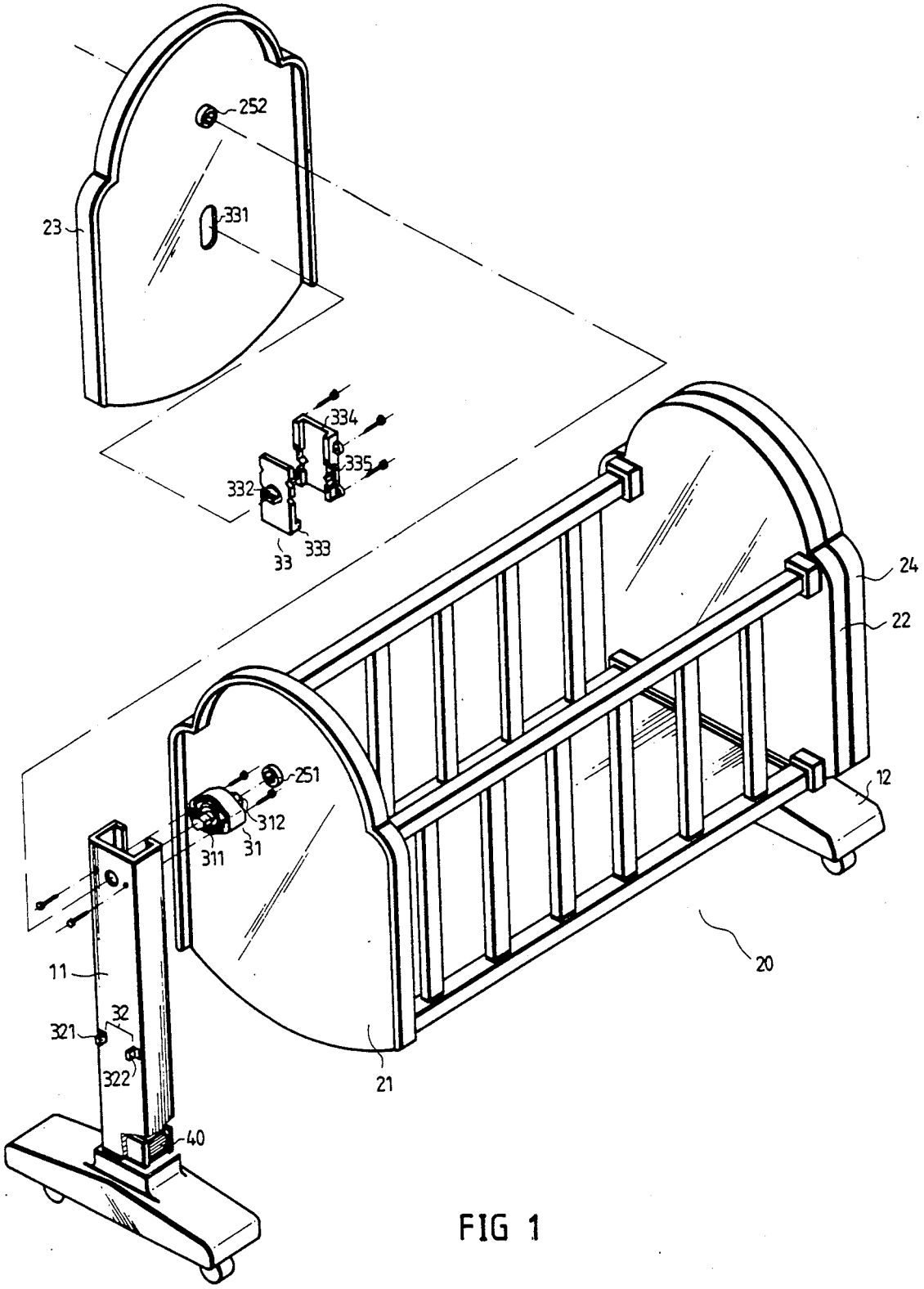
FIG. 1 shows vies of partially disassembled parts of the preferred embodiment of the present invention.

Referring to FIG. 1, a reciprocating apparatus embodied in the present invention comprise a support frame 10 having two lateral braces 11 and 12 attached thereto, 2 crib 20 having two reciprocating frames 21 and 22 laterally fastened thereto, a bering 31 fastened securely to the top portion of the U-shaped braces 11 and 12 and having two hexagonal shafts 311 and 312 attached thereto, two brace covers 23 and 24 fastened to two reciprocating frames 21 and 22, and hexagonal sleeves 251 and 252 serving to accommodate shafts 311 and 312 in order to support the crib 20 which makes a reciprocating motion on the basis of the bearing 31 as an axial center.

One of braces 11 has a stoppage seat 32 formed by two parallel stopper 321 and 322 of equal height disposed at mid-section of the outer side wall thereof. The brace cover 23 has a switching member 33, which is disposed at mid-section thereof and is positioned correspondingly to that of the stoppage seat 32. The switching member 33 comprises a slot 331, a restrictor plug 332, and a plug head 333. The restrictor plug 332 is fixed by means of a plug holder 335 of the position seat 334 at a position located between position seat 334 and the slot 331 of the brace 23. The restrictor plug 332 is capable of sliding upward and downward along the slot 331 so as to permit the vertically suspended crib 20 to force the restrictor plug 332 downward, causing the plug head 333 to rest on the stoppage seat 32. As a result, the crib 20 is effectively refrained from moving.

Figure 2:
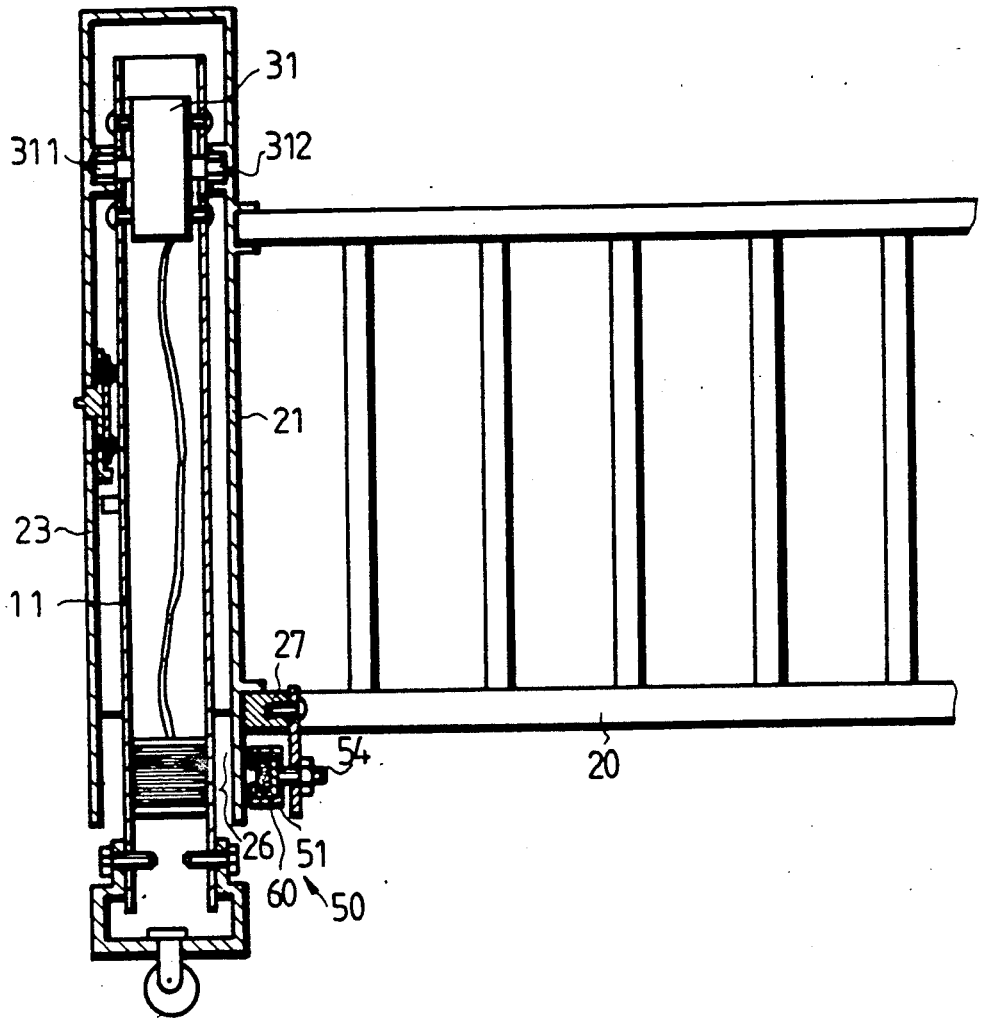
FIG. 2 shows a partial perspective vies of the preferred embodiment of the preferred embodiment of the present invention.
Figure 3:
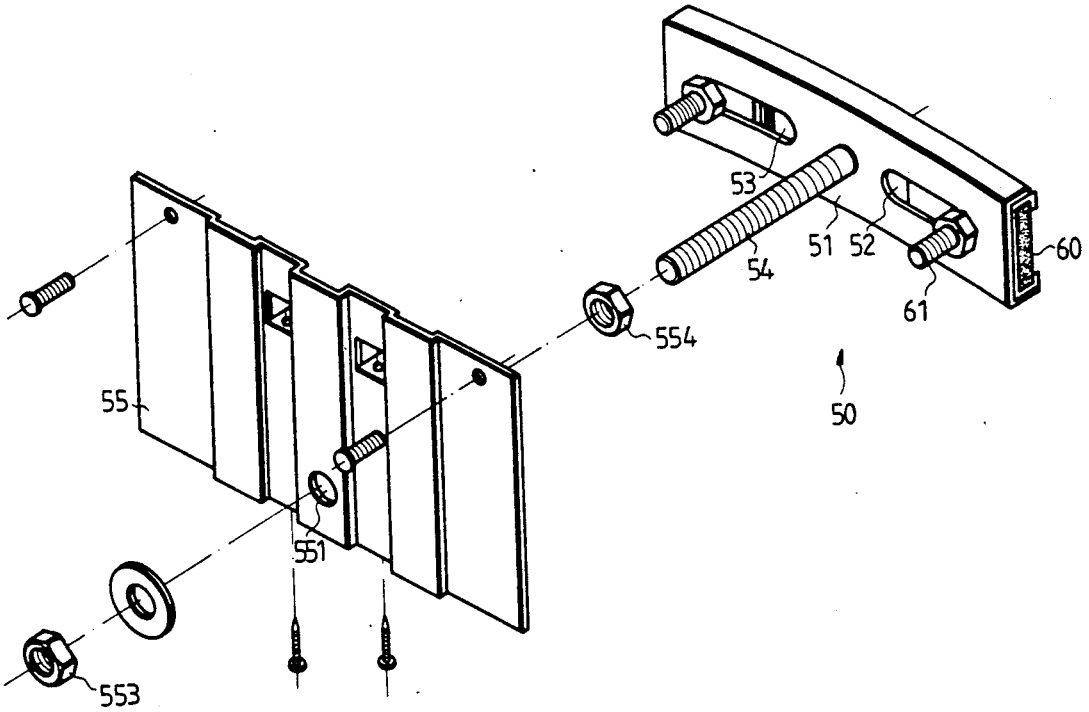
FIG. 3 shows a perspective view of the disassembled magnetic apparatus of the preferred embodiment according to the present invention.
Figure 4:
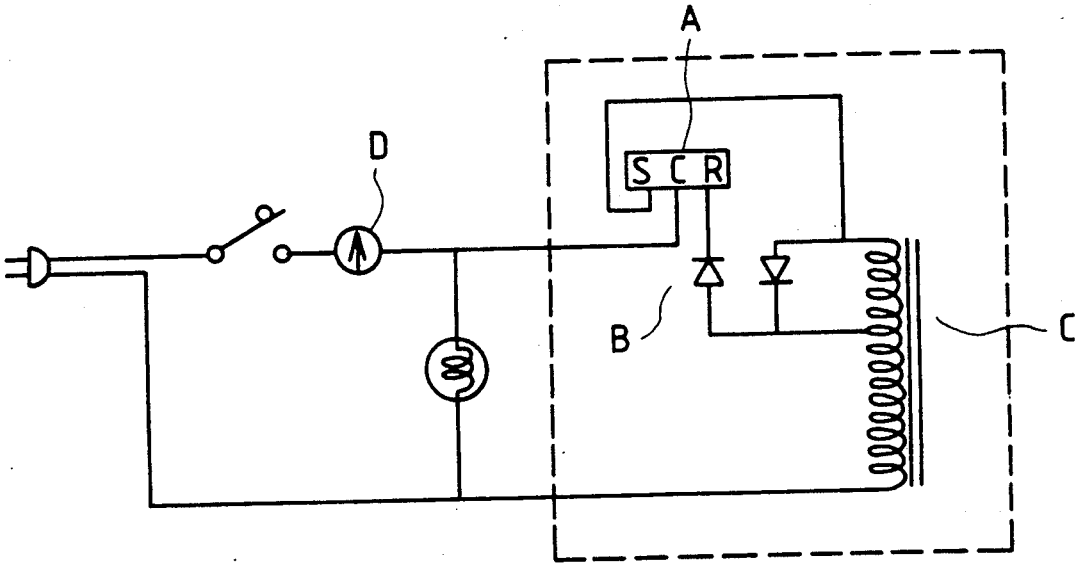
FIG. 4 shows a circuit of the electrical apparatus embodied in the present invention.

Now referring to FIGS. 2, 3 and 4, the brace 11 has an electrical apparatus 40 installed at the bottom portion thereof. The electrical apparatus 40 is capable of generating 2 magnetic force by virtue of an excited magneto-circuit disposed therein. As shown in FIG. 4, the excited magneto-circuit includes a silicone controlled rectifier, or SCR(A), a rectifying bipolar body (B), an excited magnetocoil (C), and a timer (D).

The reciprocating frame 21 of the crib 20 extends downward to form a partition 26, which is non-conductive to magnetism, with its front side facing the electrical apparatus 40. Installed on the back side of the partition 26 is a magnetic device 50 comprising mainly two permanent magnets 60, which, in turn, are adjustably dispose in a set member 51, as shown in FIGS. 2 and 3. Since these two permanent magnets 60 are positioned oppositely to the electrical apparatus 40, the opposing magnetic forces generated would cause the crib 20 to make a reciprocating movement.

The position of two permanent magnets 60 can be adjusted inside the U-shaped set member 51. Two elongated grooves 52 and 53 are set up for this purpose. These two permanent magnets 60 are fastened to bolts 61 respectively. Therefore, the positions of these two permanent magnets 60 can be adjusted by sliding the bolts 61 along the elongated grooves 52 and 53. The U-shaped set member 51 is anchored to a screw rod 54, which, in turn, is fastened through a bore hold 551 to a set member support 55 a cancavo-convex structure. The set member support 55 is coupled to the horizontal frame 27 of the crib 20. The screw rod 54 is thus securely fastened by means of two nuts 553 and 554. Therefore, the distance that separates the partition 26 and the electrical apparatus 40 can be adjusted.

The advantages of the present invention include a greater feasibility of adjusting the range of the reciprocating movement of the crib as desired, a quiet and vibration-free crib, safety feature of all parts of the crib being properly concealed, and freedom of choice of using the crib as either a static or a moving crib.

The embodiment of the present invention described above is to be considered in all respects as merely an illustration of principles of the present invention. Accordingly, the present invention is to be limited only by the scope of the hereinafter appended claims.

I claim:

1. A swinging assembly for cribs comprising:

a crib with two opposite inner frames disposed at two opposite sides of said crib;

two corresponding outer frames matching said two opposite inner frames respectively;

two lateral braces supporting said two inner frames respectively;

each of said lateral brace disposed between each of said corresponding inner frame and outer frame respectively;

a bearing disposed between said inner frame and said lateral brace;

said bearing connected to an upper portion of said lateral brace and an inner periphery of said inner frame;

at least a protrusion stopper disposed on an outer periphery of said lateral brace;

a switching apparatus disposed between said lateral brace and said outer frame;

said switching apparatus having an outer positioning seat and an inner positioning seat;

said inner positioning seat abutting an outer periphery of said lateral brace;

said outer positioning seat having a knob passing through a slot in a center of said outer frame;

said inner positioning seat enclosed by said outer positioning seat;

said outer positioning seat having a flange in a lower end of said outer positioning seat to be stopped by said protrusion stopper;

an electrical apparatus installed in a lower interior of said lateral brace;

said electrical apparatus having a silicon controlled rectifier, at least a diode, and a transformer;

a non-magnetic partition extending downwardly from said inner frame to face said electrical apparatus;

a magnetic device disposed at a bottom of said crib to face said partition;

said magnetic device having two permanent magnets positioned by a securing seat;

a corrugated plate disposed under said crib to position said securing seat securely.

2. A swinging assembly for cribs as claimed in claim 1, wherein said securing seat has two elongated grooves to adjust the positions of said permanent magnets respectively.

* * * * *